US009318080B1

(12) United States Patent
Medeiros

(10) Patent No.: US 9,318,080 B1
(45) Date of Patent: Apr. 19, 2016

(54) GUITAR HAVING A COMPARTMENT TO ERGONOMICALLY HOLD PORTABLE COMPUTING DEVICES

(71) Applicant: Walter Medeiros, Whitby (CA)

(72) Inventor: Walter Medeiros, Whitby (CA)

( * ) Notice: Subject to any disclaimer, the term of this patent is extended or adjusted under 35 U.S.C. 154(b) by 0 days.

(21) Appl. No.: 14/619,964

(22) Filed: Feb. 11, 2015

(51) Int. Cl.
*G10D 3/00* (2006.01)
*G10D 1/08* (2006.01)

(52) U.S. Cl.
CPC ..... *G10D 1/085* (2013.01)

(58) Field of Classification Search
CPC ..... B25J 13/02; G01L 5/226
USPC ..... 84/291
See application file for complete search history.

(56) References Cited

U.S. PATENT DOCUMENTS 3,589,062 A 6/1971 Desmond
5,095,795 A 3/1992 Wilfer
6,933,430 B2 8/2005 Oskorep
2004/0074380 A1* 4/2004 Fishman ..... G10H 3/186 84/741
2007/0000375 A1 1/2007 Harrison
2015/0199948 A1* 7/2015 Fishman ..... G10H 3/18 84/726

* cited by examiner

*Primary Examiner* — Jianchun Qin
(74) *Attorney, Agent, or Firm* — Nasser Ashgriz; UIPatent Inc.

(57) ABSTRACT

A guitar having a compartment for a portable computing device, said compartment comprising of a rectangular opening being embedded on said guitar body to fit said portable computing device, a built-in recharger and an adaptor or a guitar interface; a cover being connected to said bottom of said opening pivotally coupled to said opening and being adjusted by a user, said cover having an inner surface and outer surface; a case being connected to said inner surface of said cover to receive said portable computing device; and a securing means to secure said cover to said opening in a specific angle; wherein by placing said portable computing device on said cover, the user can adjust the angle of said cover to see said portable computing device.

3 Claims, 7 Drawing Sheets

GUITAR HAVING A COMPARTMENT TO ERGONOMICALLY HOLD PORTABLE COMPUTING DEVICES

FIELD OF THE INVENTION

The present invention relates generally to musical instruments and in particular to a guitar having a compartment to hold a portable computing device, such as a smart phone.

BACKGROUND OF THE INVENTION

Smart phones and other handheld computer devices are growing in computational power every day. The smart phones and other handheld computer devices, including iOS devices such as iPhone, ipod touch and iPad, offer more speed and storage capabilities. This quality allows for novel utilization of such devices in musical instruments to provide a wide variety of sound effects and on-board sound recording studios.

Musical instruments have always been very popular in society providing entertainment, social interaction, and self-expression for many people especially young generation. Musical instruments are often used in combination with other related musical accessories, such as audio amplifiers, speakers, microphones, effect pedals, digital recorders and other devices to produce sound from digital or analog signals from the musical instrument.

The musical instruments and related accessories are used by both professional and amateur musicians to produce audio signals. The audio signal is typically an analog signal containing a progression of values within a continuous range. The musical instrument is connected to the accessories by audio cables to transmit the signals from one device to another. The audio cabling between the musical instrument and accessories requires time and expertise to set up and must remain in place during the musical performance. The audio cabling is expensive and inconvenient to transport, set up and subject to damage due to frequent usage.

Generally a musical performance requires appropriate configuration of a number of controls on different musical instruments and accessories. The controls and adjustments are often required during and between performances and are generally difficult to manage when several devices are used together.

In most of the musical instruments, control switches are mounted on an accessible surface to control the volume, frequency, tone and other aspects. For example, in an electronic guitar, there are control switches that select one or more pickups, as well as control knobs that control the volume and tonal qualities. An electric guitar is connected to an audio amplifier by an audio cable, which is connected to its output jack. A typical audio amplifier has a front panel with several control knobs, buttons, sliders and switches for amplification, volume, filtering, tone equalization, sound effects, bass, vibrato speed, and vibrato intensity. The user adjusts the knobs, buttons, sliders and switches on the front panel of the audio amplifier to dial in the desired volume and sound effects. The output of the audio amplifier is connected by a cable to a speaker to produce the sound.

As electrical instruments becoming more sophisticated, the electronics of the instruments are controlled by computer processors. Computerized electronics can allow changes of the sound of an instrument without changing the electronic instrument.

There are devices such as a smartphone that can be used in connection with a guitar to turn it into a mobile multi-effect processor and recording studio/editing suite. They offer digital versions of analog amp, effects and recording gear and can give incredibly realistic amp tones and effects, full recording processing and editing capabilities, all in a mobile app. Such devices basically include everything a performer needs and provides access to a wide variety of tones and effects and a range of features such as a speaker and a microphone, all in one device. The user can move freely without being worried about losing wire connections.

Therefore, a need exists to use such mobile computer devices along with musical instruments. In order to achieve this, the device must be mounted on the instrument in a place, where the user has easy access to all the control buttons and the touch screen, in order to adjust these apps and other controls, such as volume and tone. Although such devices have been used along with musical instruments, their use has been limited. This is due to the difficulty in installing them on a musical instrument in a manner that they can be easily used when needed and then kept hidden when not used, in order to keep the original look of the instrument.

SUMMARY OF THE INVENTION

The present invention is an electronic guitar having a built-in compartment to receive a portable computing device, such as a smart phone. Said compartment is cut into the body of the electronic guitar and has a cover to receive a portable computing device.

Said housing having a length, a width and a height to fit a computing device and its related electronic accessories. Said housing is fitted on the body of the guitar. The portable computing device is mounted on a case attached to the inner side of said cover. By opening the cover, the computing device can be easily viewed by the guitar player. This allows the player to easily access the device and change the settings to obtain a desirable sound.

By closing the cover, the system will be hidden. The outer surface of the cover is the same as that of the instrument, so that in closed position, the instrument appears as its original look. Whenever the cover is in the closed position it comes in contact with the outer surface of the body of the electronic guitar and, thereby aligned flush with the housing so that no noticeable edge is obvious.

In a preferred embodiment the cover has a hinged mechanism for opening and closing. Said mechanism may be a push and flip mechanism or push button mounted to either the cover or the musical instrument body and is movable e, e.g. pivotally or rotatably, for selectively providing access to the portable computing device. Said cover comprises of an outer surface and an inner surface. Said inner surface includes a case for receiving portable computing device, having a top edge, a bottom edge, a left edge and a right edge. Said bottom edge is being attached to the inner surface of the cover.

Whenever the cover of the compartment is being opened, the computing device opens and stands in the sight of view of the user, so that the user can have easy access to controls on the portable computing device. After adjustment of the device, the user can easily bring the cover to the closed position. Following this closing process, said portable computing device stands in the compartment in hidden position attached to the cover. Case is being selected of suitable elastic material to fit different size of devices.

The compartment for the portable computing device contains a built in recharger for the electronic device being used in the musical instrument. The power source for the recharger is being a 9 volt battery with an on-off switch to preserve batteries life embedded in the back of the guitar.

A standard electronic guitar features wire connections for external electric devices such as a tuner, microphone, recorder, and earphones. A wire is connected to volume and tone control. The wire connections are hidden in the body of the guitar. In present invention, an adaptor or a guitar interface is connected to portable computing device such as smart phone and the guitar. Once the guitar is connected to the smart phone, the control buttons are then controlled by the smart phone. Adaptors, like iRig, send the signals from the instrument into a computing device with features that have access to an amazing array of tones and effects. The user is always able to access all of their favourite amps and effects by connecting the portable computing device to the adaptor or a guitar interface.

In another embodiment of the present invention, the portable computing device is mounted in the compartment with a removable lid.

In another embodiment of the present invention, the removable cover can be a transparent cover allowing a user to see the features on the portable computing device without opening the cover.

In another embodiment said compartment having a depth to receive another device such as a synthesizer in the compartment and a portable computing device such as an iphone on the lid. This allows a possibility of a duel screen option to utilize two screens at a time.

It is an object of the present invention to have a compartment for such devices which provides easy access to portable computing devices with an opening and closing system. It is another object of the present invention to provide a compartment to receive and hold portable computing devices in different dimensions. It is another object of the present invention to have a compartment with built-in recharger for the electronic device which is used in combination with the musical instrument.

Other objects, features, and advantages of the present invention will be readily appreciated from the following description. The description makes reference to the accompanying drawings, which are provided for illustration of the preferred embodiment. However, such embodiments do not represent the full scope of the invention.

BRIEF DESCRIPTION OF DRAWINGS

Embodiments herein will hereinafter be described in combination with the appended drawings provided to illustrate and not to limit the scope of the claims, wherein like designations denote like elements, and in which:

DETAILED DESCRIPTION OF THE DRAWINGS

Figure 1:
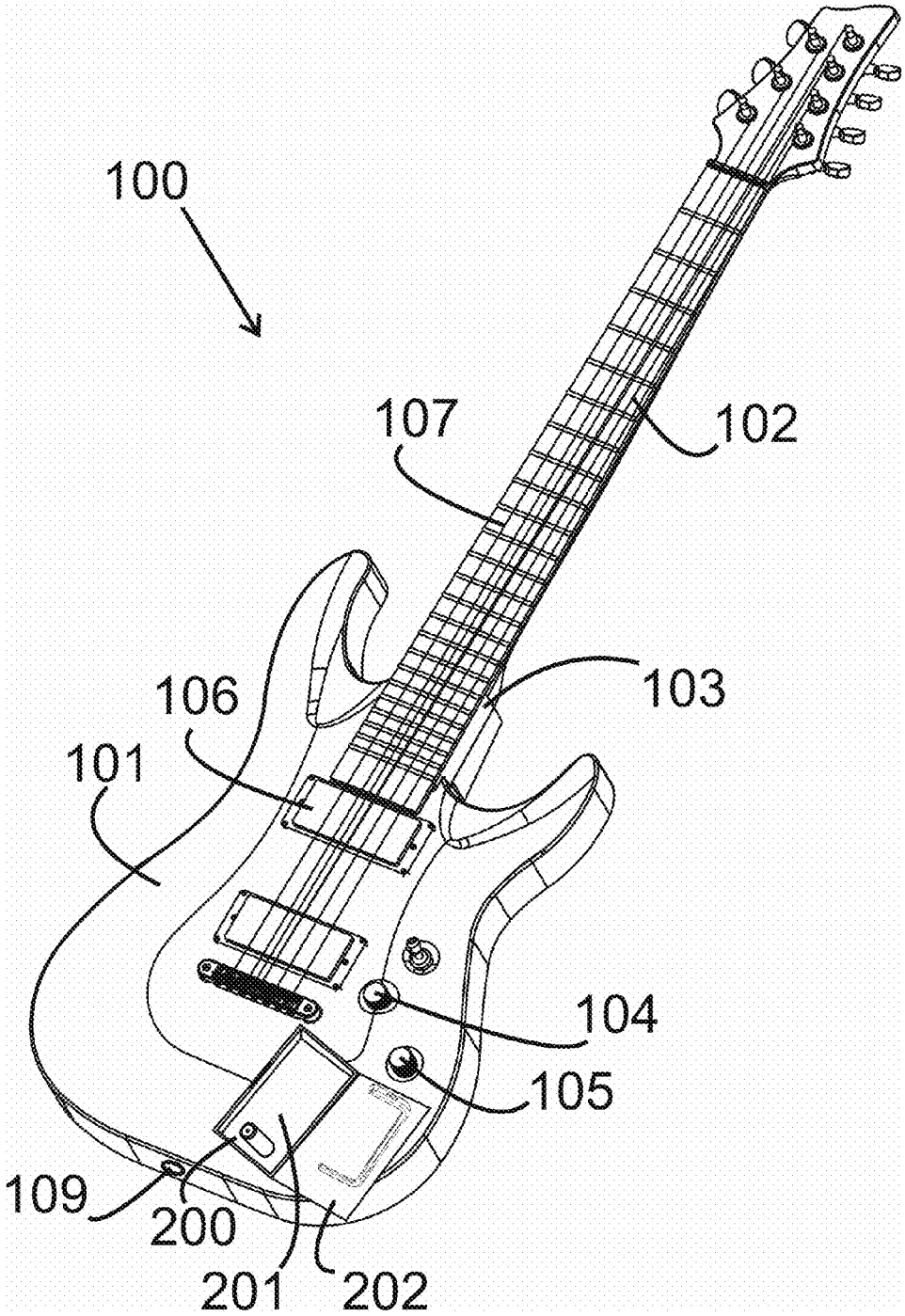
FIG. 1 is a perspective view of the front side of an electronic guitar with a compartment for portable computing device embedded thereon.

FIG. 1 is a perspective view of the front side of an electronic guitar 100 showing a compartment 200 for receiving a portable computing device in combination with an electronic guitar 100. However, the components and advantages currently disclosed are applicable to other types of electrical instruments.

Referring to FIG. 1, guitar 100 comprises a body 101, a neck 102. Body 101 and neck portion 102 are connected through neck pocket 103. The electric guitar 100 also comprises control switches for volume 104, tone 105, pickup 106, which is a transducer that captures sound vibrations from the guitar 100. The guitar 100 includes strings 107 that are secured in a manner well known in the art.

Figure 2:
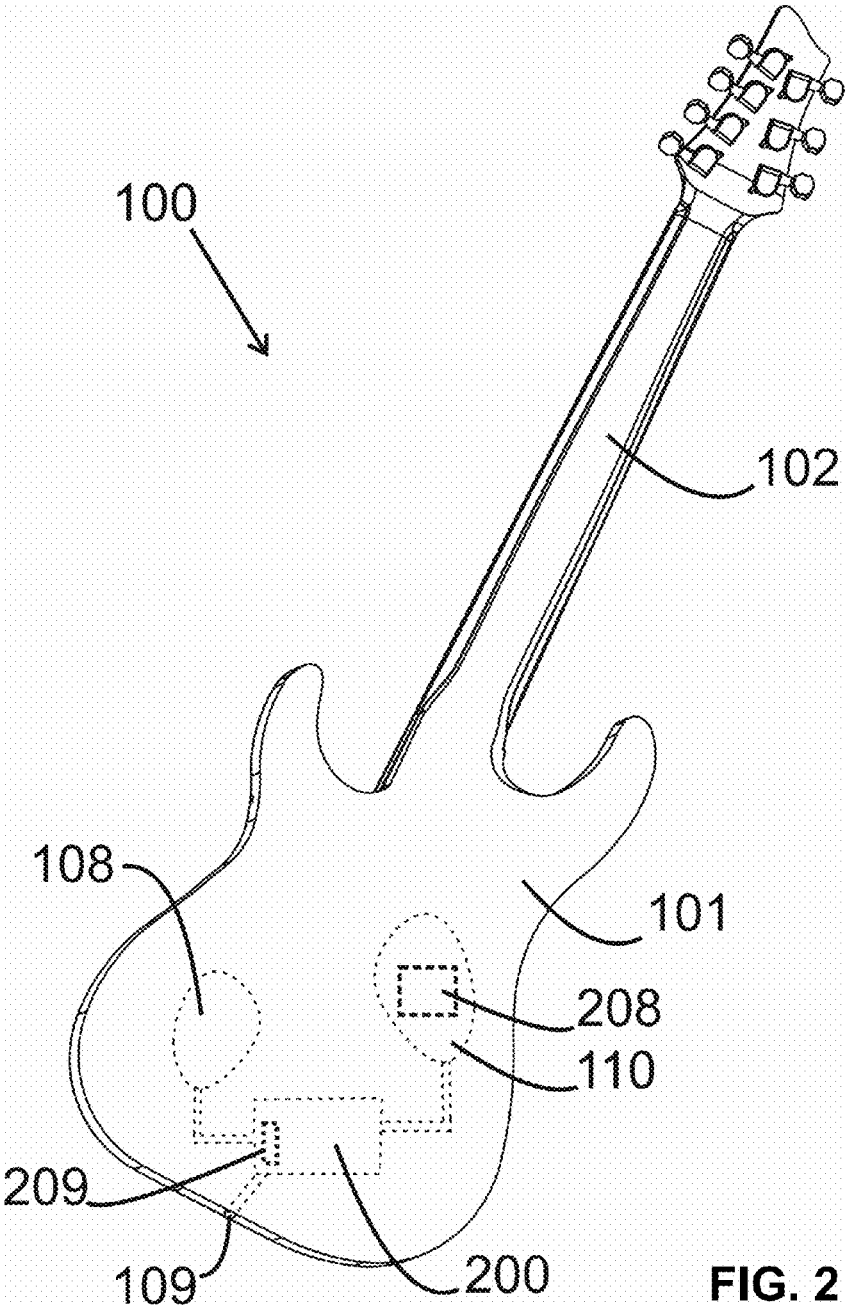
FIG. 2 is a perspective view of the back of the guitar with the cavities for the electronic wires and power source.

As shown in FIG. 2, a standard guitar 100 comprises at least one cavity 108 for the electronics which is hidden in the body of the guitar 100. All other external devices are connected to the guitar 100 through a connection 109.

In the present invention, the adaptor or guitar interface 209 is connected to portable computing device 400 such as a smart phone and the guitar 100. Once the guitar 100 is connected to the smart phone the control buttons are then controlled by the smart phone.

Referring again to FIG. 2, said guitar 100 having another cavity 110, in the back of the body of the guitar 101 in opposite side of the standard cavity 108, for receiving a power source 208. Said power source being a 9 volt battery with an on-off switch to preserve batteries life.

As shown in FIG. 2 all compartments are connected to each other. Electric connections will be possible through these paths.

Figure 3:
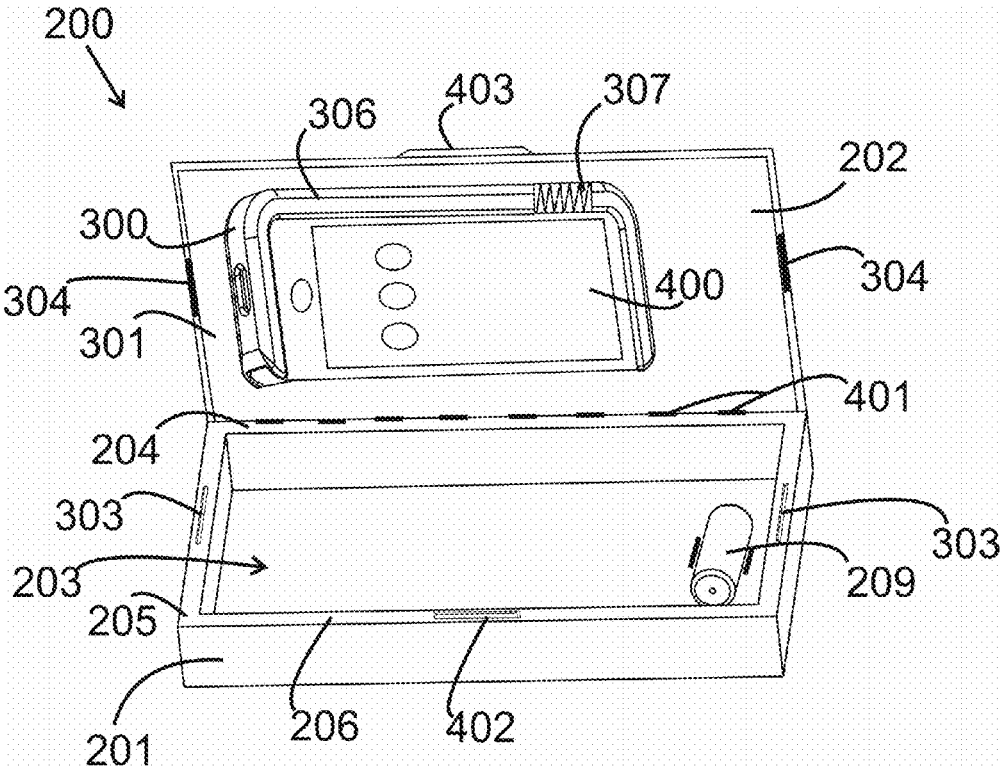
FIG. 3 illustrates a detailed view of the compartment for portable computing device.

FIG. 3 illustrates a compartment 200 for receiving a portable computing device 400 comprising a housing portion 201 and a cover 202. Said housing portion 201 having an opening 203 to fit the portable computing device 400 therein by closing the cover 202, the portable computing device 400 embedded thereon. As shown in FIG. 3, the compartment 200 sized to receive further components which are used in combination with portable computing device 400 such as built-in recharger 208 and an adaptor or guitar interface 209.

Again referring to FIG. 3, the housing 201 is integrally carved during manufacturing and is appropriately dimensioned, so as to accommodate receipt of a portable computing device 400 and an adaptor or a guitar interface 209.

Referring to FIG. 3, the housing portion 201 having a top edge 204, a left edge 205, a bottom edge 206, a right edge 207, a width and a length. Edges 204-207 are designed in a manner to fit the cover 202 thereon. The length in this embodiment is long enough to fit other devices such as an adaptor or a guitar interface 209. It is an advantage of the present invention to have the adaptor or a guitar interface 209 embedded in the housing 201 to keep the wires hidden and has easy access to said devices.

The adaptor or a guitar interface 209 allows a user to access a large bank of amps, pedals and effects directly through a portable computing device 400. The adaptor or a guitar interface 209 such as iRig gets the signals from the instrument into the computing device 400 and features to have access to an array of tones and effects. The user is always able to access all their favourite amps and effects by connecting the portable computing device 400 to the adaptor or a guitar interface 209.

Referring again to FIG. 3, a cover 202 being connected to the housing portion 201 and having an opening and closing means. The cover 202 is movably, e.g. pivotally or rotatable mounted to the compartment housing 201. Said cover 202 having an inner surface 301 and an outer surface (not shown). A case 300 is attached to the inner surface 301 of the cover 202. Said case 300 is being attached from the bottom part to the inner surface 301 of the cover 202. The case 300 further having a peripheral wall 306 to receive a portable computing device 400 by substantially covering the entire device except the screen side and providing cut out portion to allow for access to certain portions of the portable computing device.

The wall 306 as shown in FIG. 3 has a means 307 to change the length of the wall 306 to receive different sizes of portable computing device. One of the embodiments for the means 307 to change the length of the wall 306 is an accordion wall being equipped with a spring to grab the portable computing device 400.

Whenever said cover 202 is in closed position, the portable computing device 400 fits in the housing 201 of the compartment and can be plugged into the recharger 208. Cover 202 comes in contact with the face side of the body portion 101 of the electronic guitar 100 and thereby aligned flush with the housing 201 so that no noticeable edge is present there.

Said cover 202 having a thickness to receive a built in channel to keep the connection wires hidden.

As shown in FIG. 3, the user can open the compartment 200 and reach the portable computing device 400 to control the guitar. When the user opens the compartment 200, the cover 202 is exposed to the user's view and because the portable computing device 400 being installed in the cover 202, the user can see and control the guitar 100 easily.

Referring again to FIG. 3, the cover 202 is generally a rectangular lid suitable for casing a portable computing device 400. Said cover 202 is being coupled to the housing 201 by hinges 401. Any hinge mechanisms and assemblies may be suitably employed to couple the cover 202 and the housing 201 together.

Referring again to FIG. 3, cover 202 includes a catch assembly 403 in the front edge, and the housing 201 further includes a front shelf 402 on bottom edge 206 to secure the cover 202 to the housing in closing position. Said housing 201 has stabilizing grooves 303 on left edge 205 and right edge 207 of the housing. The cover 202 has a push section.

Referring again to FIG. 3, the cover 202 also includes a catch assembly 403 located proximate to the front edge of cover. The cover 202 includes a push section. The cover 202 includes stabilizing ribs 304 on side edges and will engage with stabilizing grooves 303 on the housing 201. In addition, the cover 202 having a catch assembly 403 to secure the cover 202 to the housing 201. When the catch assembly 403 strikes the front shelf 402 of the housing simultaneously falls down into and is received by the front shelf 402. By opening the cover 202 a down ward pressure is applied to the push section and the means of catch assembly begin to pull free of the front shelf and the cover 202 moves upwardly and the compartment assumes an open position.

From open position the cover can be reverted back to the closed position again, by a force toward the front of the cover 202 and the cover pivots closer to the housing 201 until the cover 202 is seated in front shelf 402.

Whenever cover 202 is in the closed position it comes in contact with the face side of the body portion 101 of the electronic guitar and thereby aligned flush with the housing 202 so that no noticeable edge is present there.

Figure 4:
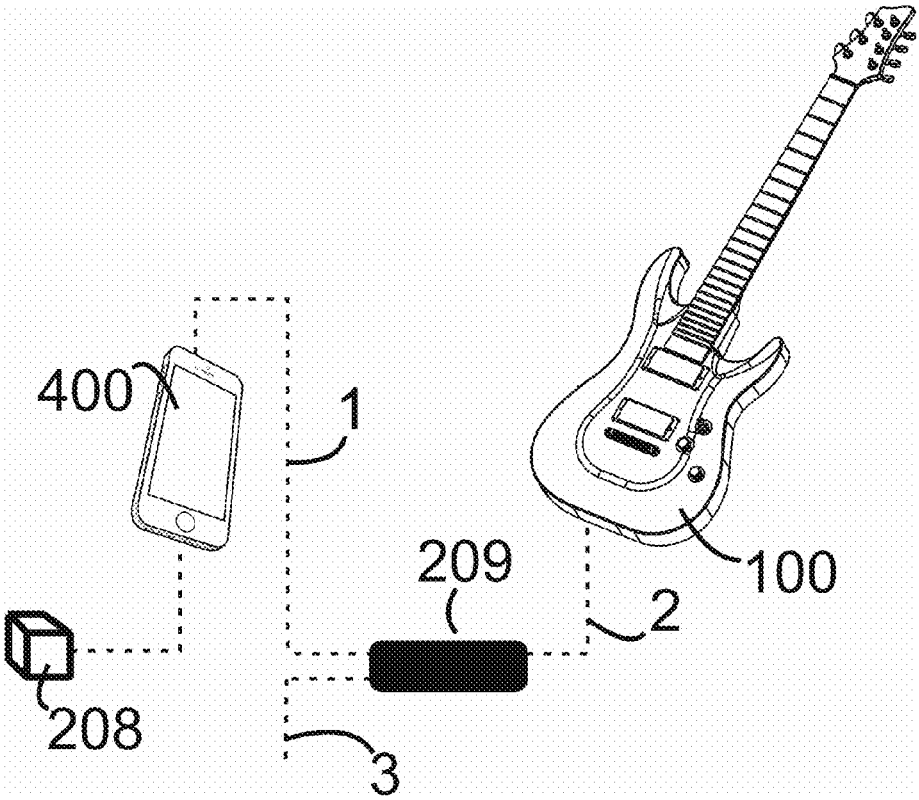
FIG. 4 shows a diagram that shows components of the present invention connect.

FIG. 4 is a diagram that shows how various components of the present invention connect and shows how the adaptor or guitar interface 209, like iRig, allows the user to connect guitar 100 to a portable computing device 400, like iPhone. The Adaptor or a guitar interface 209 is connected to the iPhone through head phone jack 1 and to the guitar using a standard guitar cable 2. Portable computing 400 device can also easily connect to the charger 208 embedded in the housing. The user can also plug head phones into head phone jack on iRig 3.

Figure 5:
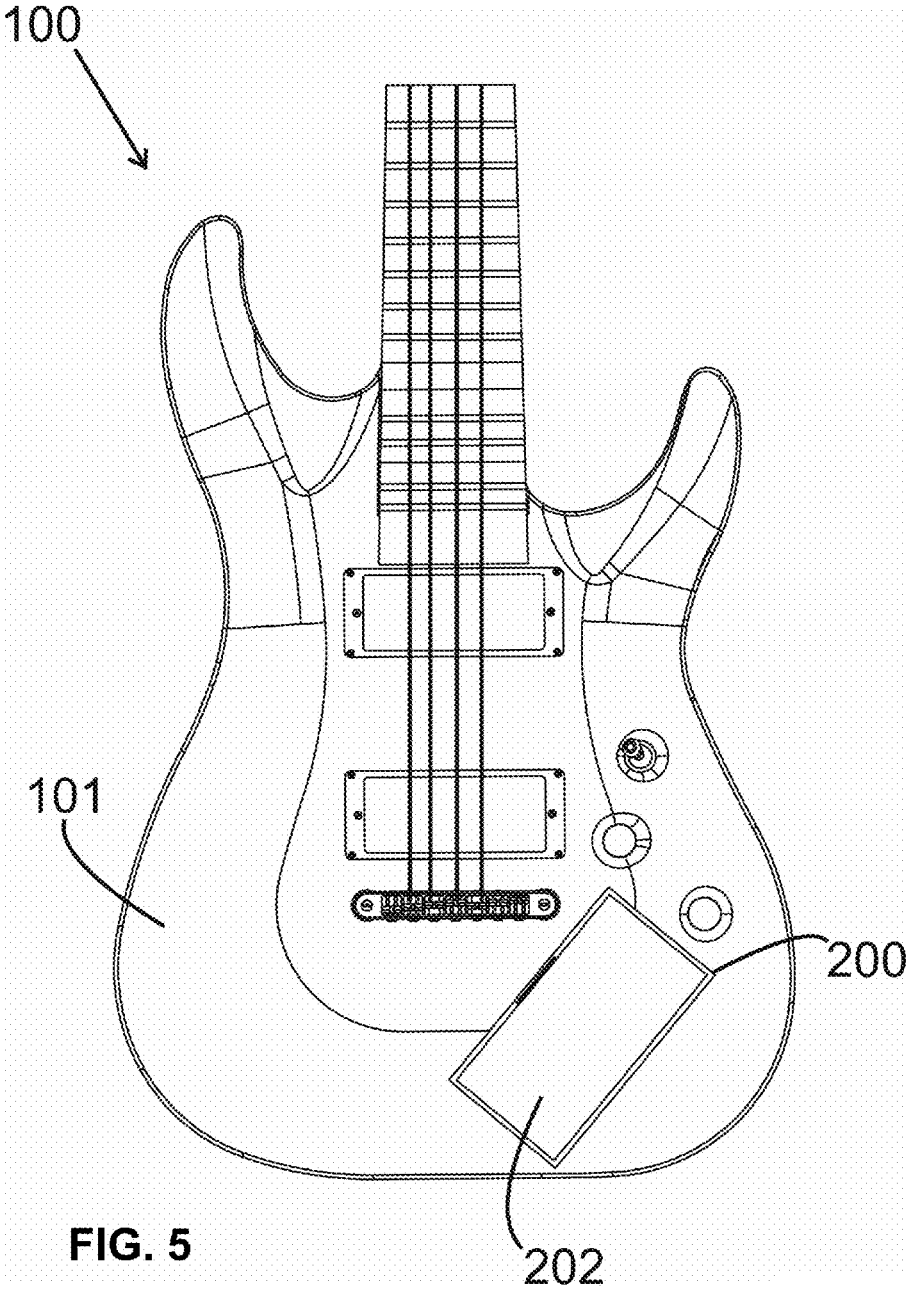
FIG. 5 is a perspective view of an electronic guitar showing the compartment in closed position thereon.

FIG. 5 is a perspective views of the preferred embodiment of the compartment of portable computing device showing 200 the compartment in closed position. Whenever cover 202 is in the closed position it comes in contact with the face side of the body portion 101 of the electronic guitar and thereby aligned flush with the housing 202 so that no noticeable edge is present there.

According to FIG. 5, cover 202 can be moulded and carved according to the body 101 of the electric guitar which are constructed of different kinds of woods and carved by CNC machines and are painted to the same color of the body 101. The compartment 200 can be vertically or horizontally embedded on the guitar, which in this embodiment is horizontally adjusted on the top portion of the guitar. The cover 202 may be transparent, translucent to emit light effects produced from the device.

Any other opening and closing mechanisms can also be used in combination with the present invention. In some embodiment the hinge mechanism includes a rotation axis. The hinge mechanism includes an activator, for example a button to direct movement of the cover which is disposed at a side of the housing. The button is connected to an activator means to open the cover on a viewing angle by a user. The activator means can be any kind of opening mechanisms which are known in the prior arts and can eject the cover. The opening and closing mechanism can also be a push button system.

Figure 6:
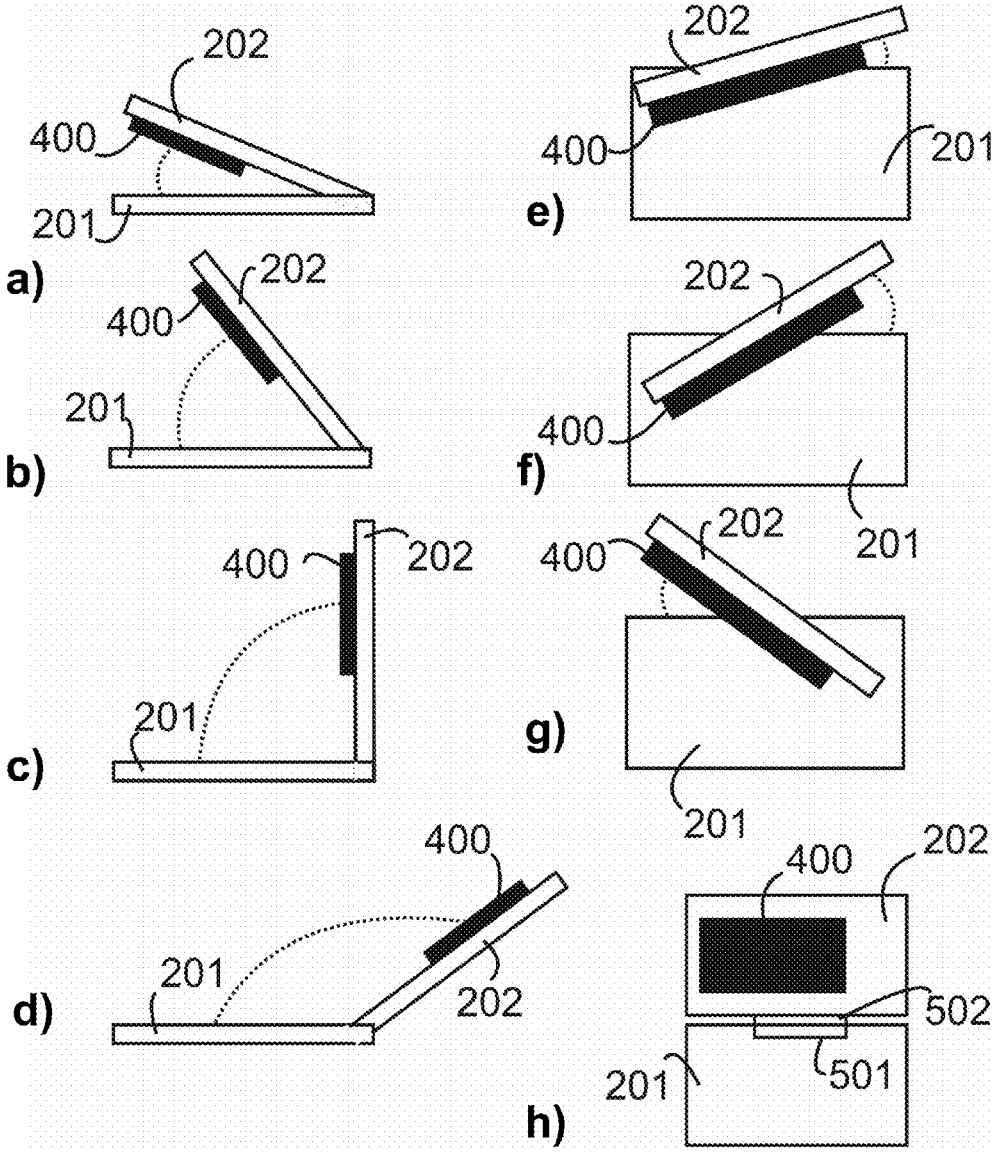
FIG. 6 shows the opening and rotation stages of the cover and the portable computing device thereon.

In another embodiment of the present invention, the hinge mechanism allows the cover and the portable computing device to be placed thereon for articulation up to 180 degrees from the housing as shown in FIG. 6.

Referring to FIG. 6, some hinge mechanism includes a rotational movement which allows the cover 202 to rotate side to side. This allows the user to have easy access to the portable computing device and can be adjusted to suit the user's position. FIG. 6 (*a-d*) shows the movement of the cover 202 and the portable computing device 400 thereon in various angles. FIG. 6 (*e-g*) show the rotation of the cover 202 and the portable computing device 400 from side to side.

Referring to FIG. 6 (*h*), the hinge mechanism having a joint unit 502 attached to a recess 501 which serves as a recess for accommodating the hinge unit. The joint unit 502 allows the cover 202 to move angularly in the horizontal direction and also move rotatably about an axis in side direction.

Figure 7:
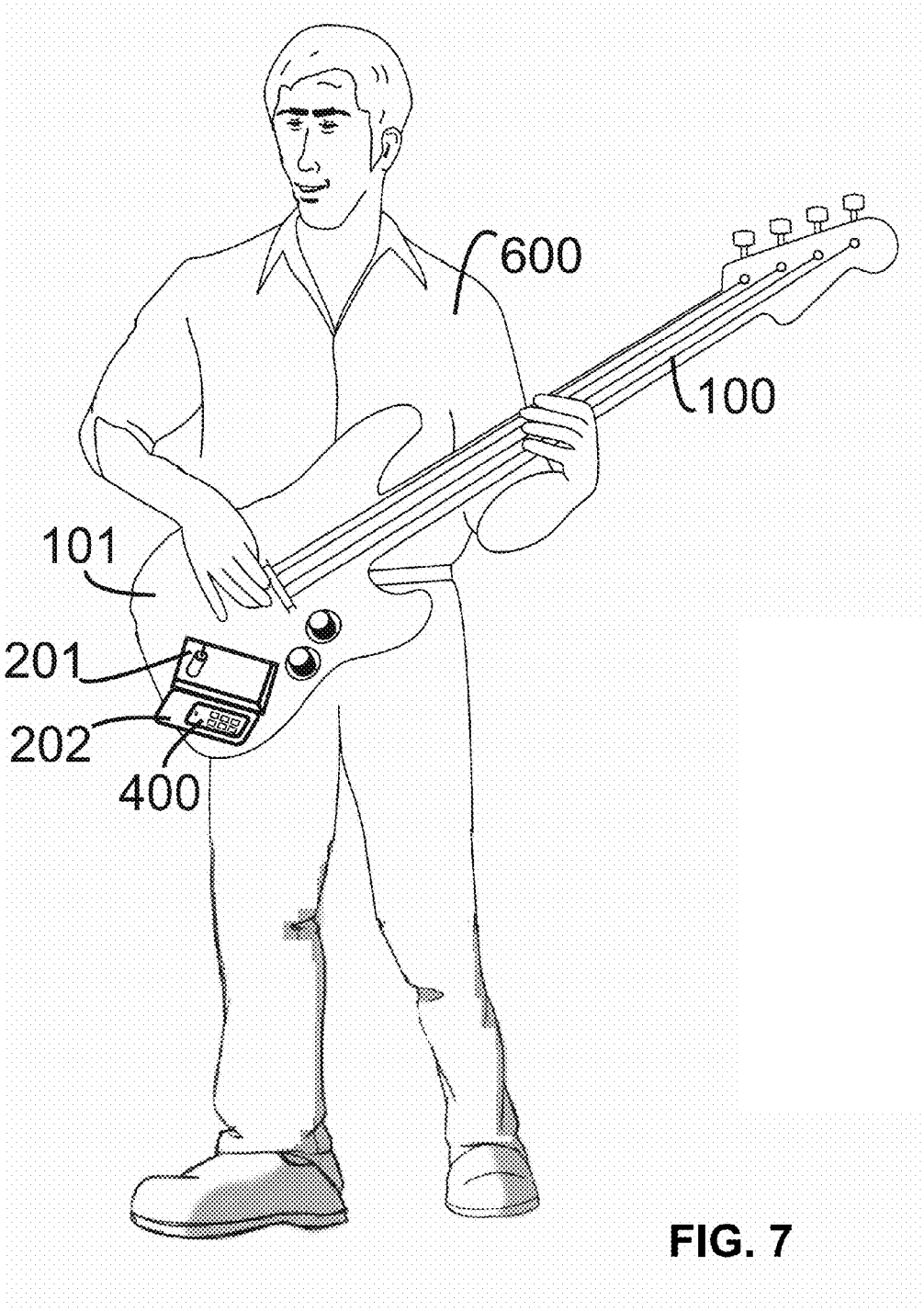
FIG. 7 shows the electronic guitar with the compartment of the present invention thereon in open position used by a guitar player.

In FIG. 7 a guitar 100 with the compartment thereon used by a guitar player 600 is illustrated. As shown a user 600 in standing position is holding the guitar 100. The compartment 200 for portable computing device 400 is embedded on the body 101 of the guitar 100. The cover 202 of said compartment 200 is in open position and the portable computing device 400 stands in the sight of view of the user 600, so that the user 600 can have easy access to controls on the portable computing device 400.

Another embodiment of the present invention is that the electric guitar of the present invention further having a touchscreen monitor on the cover of the compartment, the touchscreen monitor being connected to a micro-processor to receive an electric signal from said guitar; the micro-processor processes and changes said electric signal and the monitor displays the varieties of options. The user can change the signals by touching the touchscreen monitor which is built into the body of the guitar.

While the subject invention has been described with reference to the preferred embodiments, it should be understood that various changes and modifications could be made therein, by one skilled in the art, without varying from the scope and spirit of the subject invention as defined by the appended claims.

The forgoing is considered as illustrative only of the principles of the invention. Further, since numerous modification and changes will readily occur to those skilled in the art, it is not desired to limit the invention to the exact construction an operation shown and described, and accordingly, all suitable modifications and equivalents may be restored to, filling within the scope of the invention.

With respect to the above description, it is to be realized that the optimum relationship for the parts of the invention in regard to size, shape, form, material, function and manner of operation, assembly and use are deemed readily apparent and obvious to those skilled in the art, and all equivalent relationships to those illustrated in the drawings and described in the specification are intended to be encompassed by the present invention.

What is claimed is:

1. An electric guitar having a compartment for receiving a portable computing device having a touchscreen monitor comprising:

a. a neck and a body;

b. a compartment being embedded in the body of said guitar, said compartment sized to receive said portable computing device plus a built-in recharger and an adaptor;

c. a compartment-cover being pivotally and rotatably connected to said compartment;

d. said cover having a touchscreen monitor, said touchscreen monitor being connected to a micro-processor to receive an electric signal from said guitar; the micro-processor processes and changes said electric signal; and e. a receiving means to receive said adaptor, whereby the position of said cover is adjusted to view and control the touchscreen monitor.

2. The electric guitar of claim 1, wherein said compartment further having an output channel to connect said adaptor to said guitar.

3. The electric guitar of claim 1 wherein said cover being attached to said opening by a set of hinges, wherein said hinge having means to allow the cover to move angularly in a horizontal direction and rotate about an axis in a side direction.

* * * * *